United States Patent [19]

Leigh et al.

[11] Patent Number: 4,881,669

[45] Date of Patent: Nov. 21, 1989

[54] DISPENSER VALVE AND METHOD OF FORMING THE SAME

[75] Inventors: James P. Leigh; Henry G. Roethel, both of Ravenna, Ohio

[73] Assignee: The Meyer Company, Cleveland, Ohio

[21] Appl. No.: 207,742

[22] Filed: Jun. 16, 1988

[51] Int. Cl.[4] ..... B67D 3/00

[52] U.S. Cl. ..... 222/505; 222/509; 222/517; 222/556; 137/15; 251/298; 251/339

[58] Field of Search ..... 222/505, 508, 509, 511, 222/512, 517, 556; 137/15; 251/339, 298

[56] References Cited

U.S. PATENT DOCUMENTS

| | | | |
|---|---|---|---|
| 2,021,731 | 11/1935 | Leins | 222/82 |
| 3,195,573 | 7/1965 | Daumy | 137/625.4 |
| 3,400,866 | 9/1968 | Fattori | 222/511 |
| 3,416,567 | 12/1968 | Von Dardel et al. | 137/605 |
| 3,434,695 | 3/1969 | Green | 251/349 |
| 3,443,728 | 5/1969 | Scholle | 222/511 |
| 3,690,344 | 9/1972 | Braumm | 137/625.28 |
| 4,169,548 | 10/1979 | Bond | 222/511 |
| 4,275,765 | 6/1981 | Dugas | 137/625.48 |
| 4,355,742 | 10/1982 | Scholle | 222/505 |
| 4,621,750 | 11/1986 | Roethel | 222/505 |

*Primary Examiner*—Joseph J. Rolla
*Assistant Examiner*—Steven M. Reiss
*Attorney, Agent, or Firm*—Fay, Sharpe, Beall, Fagan, Minnich & McKee

[57] ABSTRACT

A valve structure formed from a single tubular plastic component having two integral tube sections. A first section includes a flow orifice. The second section constitutes the valve element for controlling flow through the orifice by being inverted relative to the first section to overlie the orifice in sealing relationship thereto. In the preferred embodiments of the specification, the second section is invaginated into a compressed position within the first section.

21 Claims, 2 Drawing Sheets

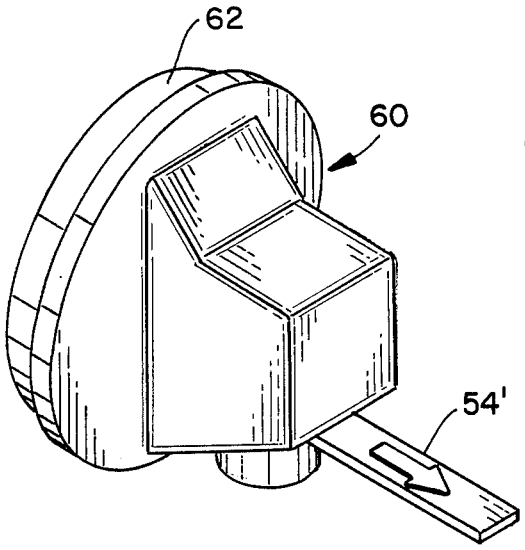
FIG. 6
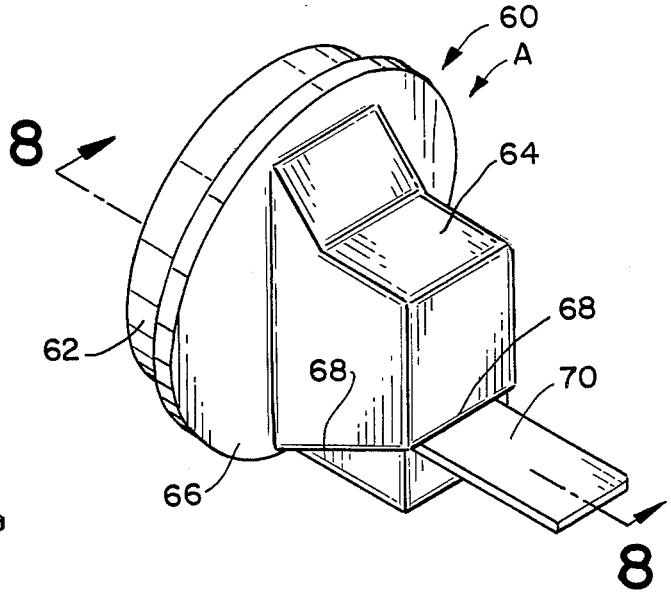
FIG. 7
FIG. 8
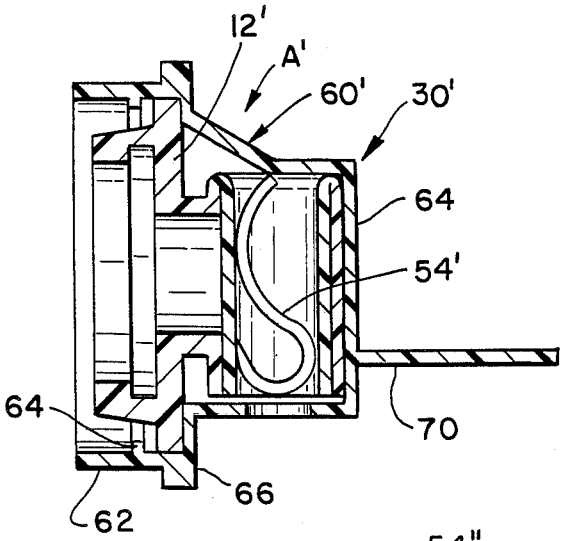
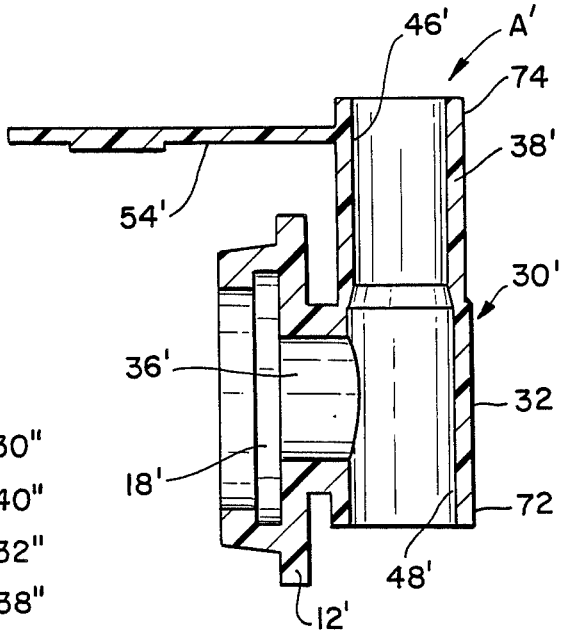
FIG. 9
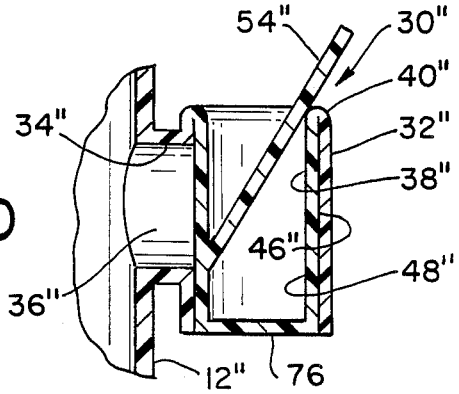
FIG. 10

DISPENSER VALVE AND METHOD OF FORMING THE SAME

BACKGROUND OF THE INVENTION

The subject invention is directed to a valve of the type used for dispensing beverages and will be described with particular reference thereto; however, the invention is capable of broader application and could be used for forming a variety of valves, taps, and dispensing faucets.

In the prior U.S. Pat. No. 4,621,750, issued Nov. 11, 1986, and titled "Dispenser Valve", there is disclosed a valve for dispensing fluid products which comprises a tubular discharge nozzle or passageway having a longitudinal bore which communicates with an inlet passage through a port in its side wall. A valve or seal element in the form of a resilient tube is located within the tubular discharge nozzle. The seal element is compressed or interference fitted within the nozzle and seals about the port. A handle assembly is arranged to allow selective shifting of the seal element between open and closed or sealed positions.

The valve of the noted patent is relatively inexpensive to manufacture and closes the port in a drip-free, leak-proof manner. A further advantage of the valve is that it can be formed from only two or three elements.

The subject invention provides a significant improvement to valves of the type described above and still further reduces the cost of the valve while simplifying its manufacture.

BRIEF SUMMARY OF THE INVENTION

In accordance with one aspect of the invention, a valve for dispensing fluid products comprises a body member including a first tubular portion defining a first passageway and a second portion having a second passageway disposed in fluid communication to the first passageway at a port disposed in the side wall of the first passageway. The body member further includes a resilient third portion of tubular configuration integrally joined to the first tubular portion to form an integral continuation thereof. The third portion is inverted or invaginated relative to the first tubular portion to sealingly engage the first tubular portion with an interference fit and overlie the port to prevent fluid flow therethrough. Operating means are associated with the third portion for selectively deflecting it away from the port to permit fluid flow from the second passageway to the first passageway.

In accordance with a more limited aspect of the preferred invention, the first and third tubular portions of the body member are preferably of cylindrical configuration and are joined at a tapered transition zone.

In accordance with a still further aspect of the preferred invention, the inner diameter of the first tubular portion is at least slightly less than the outer diameter of the third tubular portion.

In accordance with another aspect of the preferred invention, there is provided a method of forming a dispensing valve which includes providing a tubular body having a first circumferentially continuous side wall portion and a second relatively resilient circumferentially continuous side wall portion which extends from and forms an integral continuation of the first wall portion. A flow passage port is formed through the first side wall portion and the second relatively resilient side wall portion is inverted relative to the first side wall portion to sealingly overlie the flow passage port.

Preferably, in accordance with a further aspect of the invention, the first and second side wall portions are molded simultaneously from the same resinous plastic material and the second sidewall portion is invaginated into the first sidewall portion.

The design and construction of the subject valve is such that the entire valve can be formed from a single injection molded plastic component. This makes the valve extremely simple and inexpensive to manufacture. As a consequence, it is especially suited for use as a disposable valve on "bag-in-the-box" or "membrane" type beverage containers.

A further object and advantage of the invention is that the resulting valve is capable of use throughout a wide range of temperatures.

Another object of the invention is the provision of a valve wherein the valve element is an integral portion of the valve body to thereby eliminate any special hinges, operators, or the like.

Other objects and advantages of the invention will become apparent to those skilled in the art upon a reading and understanding of the following detailed specification.

BRIEF DESCRIPTION OF THE DRAWING

The invention may take physical form in certain parts and arrangement of parts, preferred and alternate embodiments of which will be described in detail in this specification and illustrated in the accompanying drawings which form a part hereof, and wherein:

FIG. 6 is a perspective view of a second embodiment of dispensing valve formed in accordance with the invention;

FIG. 7 is a view similar to FIG. 6 but showing the FIG. 6 valve prior to the removal of a portion of the overlying valve cover;

FIG. 8 is a cross-sectional view taken on line 8—8 of FIG. 7;

FIG. 9 is a cross-sectional view of the valve portion of the FIG. 6 embodiment shown in the "as molded" condition; and, FIG. 10 is cross-sectional view like FIG. 3 but showing a third embodiment of the invention.

DETAILED DESCRIPTION OF THE PREFERRED AND ALTERNATE EMBODIMENTS

Figure 1:
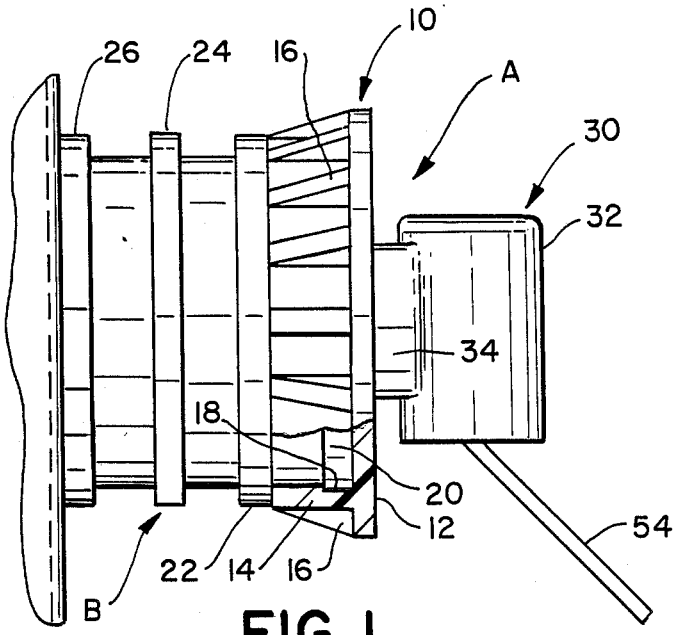
FIG. 1 is a side elevational view partially in section, showing a preferred embodiment of the subject dispenser valve construction.

Referring now to the drawings, wherein the showings are for the purpose of illustrating the preferred and alternate embodiments of the invention only, and not for the purpose of limiting same, FIG. 1 shows the new dispenser valve A associated with a bag-in-the-box type outlet nozzle B. As noted earlier, the subject valve assembly is particularly suitable for use with the disposable bag-in-the-box type of beverage containers. It should, however, be appreciated that the inventive concept involved could equally well be adapted to use in other valve and dispensing environments.

Figure 2:
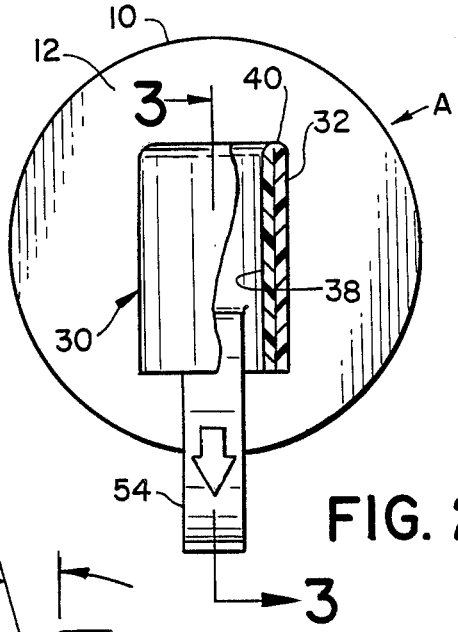
FIG. 2 is a front end view of the valve shown in FIG. 1.

More particularly, and with reference to FIGS. 1 and 2, the valve assembly A includes a first body portion 10 comprising a first generally circular end face 12 which carries a rearwardly extending circumferential flange portion 14. Suitable web sections 16 extend between the outer peripheral section of the end face 12 and the flange 14 as shown. The web sections 16 serve to provide rigidity to the circumferential flange 14. Flange 14 is further provided with an internal circumferential recess 18 which is positioned and sized so as to tightly and resiliently receive a flange 20 which extends radially outward from the nozzle assembly B. The nozzle assembly B could have a variety of configurations but is shown as being cylindrical and provided with a plurality of spaced outwardly extending flanges 20, 22, 24, and 26. To assist in the installation of the body section 10 to the nozzle B, a tapered section 28 (see FIG. 4) is provided about the entrance to the circumferential rearwardly extending flange 14.

Figure 3:
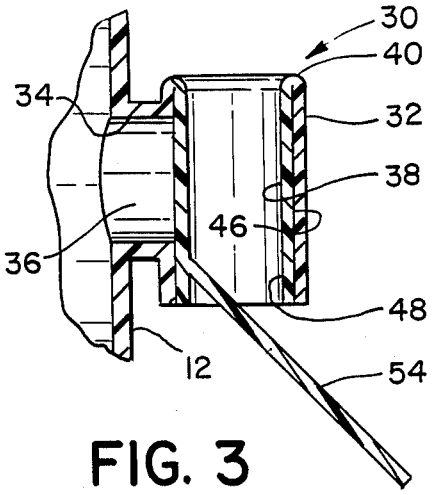
FIG. 3 is a partial cross-sectional view taken on line 3—3 of FIG. 2.
Figure 4:
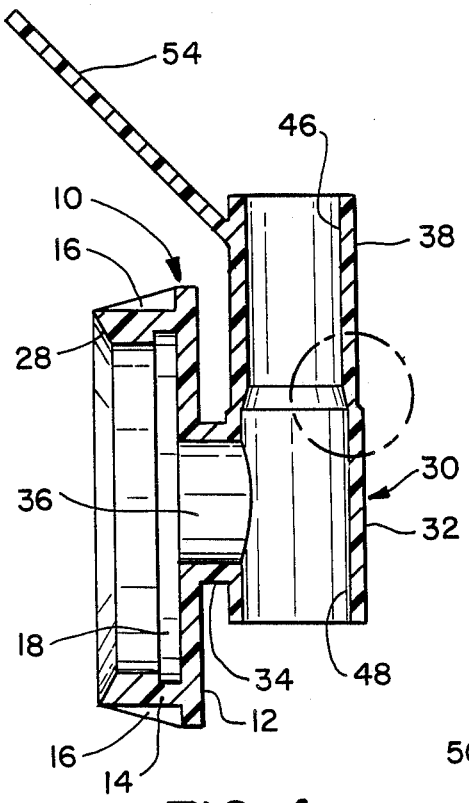
FIG. 4 is a cross-sectional view through the valve of FIG. 1 in its "as molded" condition.
Figure 5:
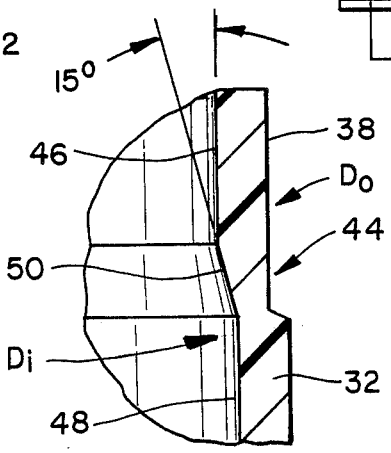
FIG. 5 is an enlarged view of the circled area of FIG. 4.

Joined to the body portion 10 is a second portion 30 which comprises a first tubular section 32 which is joined to end face 12 by an outlet or discharge passage forming tube section 34. As best shown in FIGS. 3 and 4, discharge section 34 includes a central passage 36 which opens through the end face 12. Preferably, according to the subject embodiment, the tubular section is generally cylindrical and is mounted generally perpendicular to the connecting section 34. It should be appreciated, however, that other shapes and mounting arrangements could equally well be used. The outermost end of the passage 36 constitutes a valve seat and is closed by a second tube section 38 which is closely and compressively received within the first tube section 32. As best shown in FIGS. 2 and 3, the cylindrical tube sections 32 and 38 are integrally formed and are joined at the upper end 40. According to the subject invention the two tube sections 32 and 38 are molded integrally as one piece with the original "as molded" configuration as best shown in FIG. 4. That is, the tube section 38 is axially aligned with tube section 32 and extends upwardly from the upper end thereof. As best shown in FIG. 5, the upper or second tube section 38 is joined to the lower tube section 32 through a transition zone 44. Note that the outer diameter Do of the upper tube section 38 is illustrated as slightly less than the outer diameter of the lower tube section. It is, however, greater than the inner diameter Di of the lower tube section 32. Additionally, the inner wall surface 46 of the upper tube section 38 joins to the inner wall surface 48 of the lower tube section 32 by a tapered or inclined wall 50. As shown, wall 50 is inclined at an angle of 15° relative to the wall surface 46. Although the tapered transition zone is not absolutely necessary, it facilitates the inversion of the upper tube section into the lower tube section. Moreover, it helps to locate the final position of the upper tube section in the lower tube section.

The structure shown in FIG. 4 has, as previously noted, the "as molded" shape of the valve assembly A. Many different types of resinous plastic materials having suitable characteristics of toughness and resiliency might possibly be used for forming the valve assembly A. Preferably, however, and in accordance with the preferred embodiment, the valve is injection molded in the FIG. 4 configuration from any suitable resinous plastic material such as silicone rubber, latex or some vinyls.

From the FIG. 4 configuration the upper tube section 38 is inverted and invaginated into the lower tube section 32 to assume the position shown in FIGS. 2 and 3. In this position, the upper tube section 38 is compressed and effectively interference fitted within the lower tube section 32 and sealingly overlies the outlet opening 36. The upper tube section 38 thus acts as a valve element for closing the passage 36. To selectively open the outlet end of passage 36 and permit flow to take place, the portion of tube section 38 which overlies the outlet opening 36 is deflected away from the outlet end of the passage. Many different structures could be used to allow deflection of this tube section as required. In the subject embodiment, however, a handle tab or the like 54 is molded integrally with the upper tube section 38 as shown in FIG. 4. As can be appreciated, by pulling on the handle section 54 in the direction shown by the arrow of FIG. 2, it is possible to deflect the overlying wall portion of tube section 38 to permit flow to take place outwardly through the lower end of tube section 32.

As is apparent, the subject invention allows the valve to be formed from a single plastic molding thereby eliminating all subsequent assembly operations or the like. In addition, the resulting valve element is extremely reliable and fool proof. The arrangement shown also results in a drip-free closure.

FIGS. 6 through 9 show a second or alternate embodiment of the invention. For ease of illustration and appreciation of this embodiment, like components are identified by like numerals differentiated with a prime (') suffix. In FIGS. 7 and 8 the valve assembly A' is shown as being enclosed by an injection molded plastic dust cover element 60. The dust cover element 60 includes a cylindrical collar section 62 which is arranged to closely receive the end wall 12' of the valve assembly A'. An internal flange or the like 64 maintains the dust cover in place on the end wall 12'.

A generally rectangular end section 64 extends outwardly from a circular wall 66. The section 64 is sized to closely enclose the section 30' of valve assembly A'. The lower section of portion 64 is provided with a weakened line or frangible section 68 which extends completely about the lower most portion of section 64. A tear tab 70 is provided to allow the lower section to be torn off along line 68. This exposes the discharge end of section 30' of the valve assembly A' and allows the valve to be used for the dispensing operation. As best shown in FIG. 8, the operating handle 54" of the valve assembly A' is deflected into the interior of section 30' when the dust cover assembly 60 is in place. However, after removal of the tear-away section, the handle is exposed as shown in FIG. 6. The valve assembly can then be used for dispensing fluids.

FIG. 9 shows the slightly modified valve assembly used in the dust cover embodiment. Specifically, in this embodiment the valve operating handle 54' extends perpendicularly from the tube section 38'. Additionally, the lower end of the tube section 32' is provided with a small recess opening 72. A similar recess 74 is provided at the upper end of the tube section 38' in the location shown. Thus, when the upper tube section 3' is invaginated into the lower section 32' the handle 54 can extend exactly horizontally through the mating openings 72, 74. Thus, operation of the valve requires a simple horizontal pulling motion on the handle 54'.

FIG. 10 illustrates a third embodiment of the invention which is quite similar to the FIGS. 1–5 embodiment. In this showing like components are identified by like numerals differentiated by a double prime (″) suffix. As illustrated, the FIG. 10 embodiment includes an end wall 76 which closes the end of the second tube section 38″. In addition the handle section 54″ is located such that when the valve is assembled in the operating position, the handle section 54″ extends out the upper end as shown. As can be appreciated, by pulling upwardly on the handle section 54″, the tube section 38″ is pulled away from the lower portion of outlet opening 36 to permit flow to take place.

The invention has been described with reference to preferred and alternate embodiments. Obviously, modifications and alterations will occur to others upon a reading and understanding of this specification. It is our intention to include all such modifications and alterations as part of our invention insofar as they come within the scope of the appended claims or equivalents thereof.

What is claimed is:

1. A dispensing closure assembly comprising:

a one piece tube member comprising a first tube section with a circumferentially continuous side wall and a second tube section joined with said first tube section by a relatively thinner and flexible intermediate section molded integrally with said first and second tube sections and forming a continuation thereof, said second tube section having a relatively resilient, circumferentially continuous side wall;

a fluid passage opening formed through said side wall of said first tube section;

said second tube section being inverted relative to said first tube section at said intermediate section to place the continuous side wall of said second tube section in sealing engagement with the side wall of said first tube section and overlying said fluid passage; and, means for selectively deflecting said second tube section away from said first tube section to permit flow through said fluid passage opening.

2. The dispensing closure assembly of claim 1 wherein said second tube section and is invaginated into the interior of said first tube section and is circumferentially compressed thereby.

3. The dispensing closure assembly of claim 2 including mounting means for connecting said closure assembly to the delivery end of a tubular spout, said mounting means comprising a housing member connected in flow relationship to said fluid passage opening.

4. The dispensing closure assembly of claim 1 wherein said means for deflecting said second tube section comprises a handle joined to said second tube section.

5. The dispensing closure assembly of claim 1 wherein said first and second tube sections are generally cylindrical.

6. A dispensing closure assembly comprising: a tube member having a first tube section with a circumferentially continuous side wall;

a second tube section integrally joined with said first tube section and forming a continuation thereof, said second tube section having a relatively resilient, circumferentially continuous side wall;

a fluid passage opening formed through said side wall of said first tube section;

said second tube section being inverted relative to said first tube section with the continuous side wall of said second tube section being in sealing engagement with the side wall of said first tube section and overlying said fluid passage;

means for selectively deflecting said second tube section away from said first tube section to permit flow through said fluid passage opening; and, wherein said second tube section is invaginated into the interior of said first tube section and is circumferentially compressed thereby with the side wall of said first and second tube sections being of substantially equal thickness but joined by a relatively thinner intermediate section.

7. The dispensing closure assembly of claim 6 wherein said first and second tube sections are integrally molded from a resinous plastic material.

8. The dispensing closure assembly of claim 7 wherein said first tube section has an inner open cross-section which is slightly less than the total outer cross-section of the second tube section.

9. The dispensing closure assembly of claim 8 wherein said first tube section and said second tube section are cylindrical and joined by a circumferentially continuous tapered section.

10. A method of forming a dispensing valve comprising:

(a) providing a tubular body having a first circumferentially continuous side wall portion and a second relatively resilient circumferentially continuous side wall portion which extends from and forms an integral continuation of said first wall portion;

(b) forming a flow passage port through said first side wall portion; and, (c) invaginating said second relatively resilient side wall portion into said first portion to sealingly overlie said flow passage port.

11. The method as defined in claim 10 wherein said second relatively resilient side wall portion joined to said first side wall portion by an intermediate tapered wall section.

12. The method as defined in claim 11 including the steps of forming said tubular body to have a cylindrical shape with said first tube section having an open inner diameter which is slightly smaller than the outer diameter of said second tubular section.

13. The method as defined in claim 12 including the step of forming a handle member integrally with said second tube section.

14. The method as defined in claim 11 wherein said first and second side wall portions are molded simultaneously from the same resinous plastic material.

15. A valve for dispensing fluid products comprising:

a body member including a first tubular portion defining a first passageway and a second portion having a second passageway disposed in fluid communication to each other at a port disposed in the side wall of said first passageway;

said body member further including a third portion integrally joined to said first tubular portion, said third portion being tubular and resilient and forming a continuation of said first tubular portion;

said third portion being invaginated into said first tubular portion to sealingly engage the interior of said first tubular portion and overlie said port to prevent fluid flow through said port; and, operating means for selectively deflecting said third portion away from said port.

16. The valve as defined in claim 15 wherein first and third tubular portions are of cylindrical configuration.

17. The valve as defined in claim 16 wherein said operating means includes a handle integrally formed therewith, said handle extending outwardly of said first tubular portion.

18. The valve as defined in claim 17 wherein the end of said third portion which is invaginated into said first tubular portion is closed by a transverse wall and said handle extends outwardly from the interior of said third tubular portion.

19. The valve as defined in claim 16 wherein said third tubular portion has an outer diameter which is at least slightly greater than the open inner diameter of said first tubular portion.

20. The valve as defined in claim 16 including a cover enclosing said valve, said cover included a weakened tear line, which allows a portion of said cover to be torn away to provide access to said operating means.

21. The valve as defined in claim 16 wherein said second portion includes means for permitting said body member to be mounte on the delivery end of a tubular spout.

* * * * *